US005496240A

United States Patent [19]

Damm

[11] Patent Number: 5,496,240

[45] Date of Patent: Mar. 5, 1996

[54] ARM EXERCISE DEVICE

[76] Inventor: Tony E. Damm, 111 W. Union, Mount Sterling, Ill. 62353

[21] Appl. No.: 380,699

[22] Filed: Jan. 30, 1995

[51] Int. Cl.[6] ..... A63B 21/075

[52] U.S. Cl. ..... 482/93

[58] Field of Search ..... 482/44–46, 50, 482/93, 106–109, 148

[56] References Cited

U.S. PATENT DOCUMENTS 1,422,888 7/1922 Reeves et al. ..... 482/93

4,717,147 1/1988 Rochelle ..... 482/93

*Primary Examiner*—Richard J. Apley
*Assistant Examiner*—John Mulcahy

[57] ABSTRACT

A hand held type arm exercise device wherein the device is arranged to extend an individual's arms permitting raising and lowering of a stack of weights or single weight thereof mounted about a central rod, said central rod includes a pivot axle, and the pivot axle includes a plurality of handle rods, such that pivoting of the handle rods from a first position substantially aligned with the central shaft to a second position substantially obliquely oriented to the central rod effects vertical movement of the central rod and the weights.

3 Claims, 4 Drawing Sheets

ARM EXERCISE DEVICE

TECHNICAL FIELD

The field of invention relates to exercise apparatus, particularly that related to arm development and toning, wherein the instant invention is directed to a hand-held type arm exercise device wherein the same is arranged to manipulate the device for toning while an individual remains stationary in its use.

BACKGROUND OF THE INVENTION

Various prior art hand-held type exercise devices are indicated and exemplified in the U.S. Pat. Nos. 5,167,596; 5,230,684; 5,242,349; and 5,286,243.

SUMMARY OF THE INVENTION

The present invention relates to an arm exercise device provided with an elongate rod having a support plate, such that resistance plates are mounted upon the plate about the rod, and wherein hand-held rods pivotally mounted adjacent a free end of the rod have handles at each end of the handle rods, with an axle pivotally mounting the handle rods relative to the rod, such that upon the simultaneous pivoting of the handle rods to raise and lower the rods and weights provides for toning and exercise of an individual's arms and shoulders, as well as providing for residual benefits to an individual's back and torso portions.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

Figure 2:
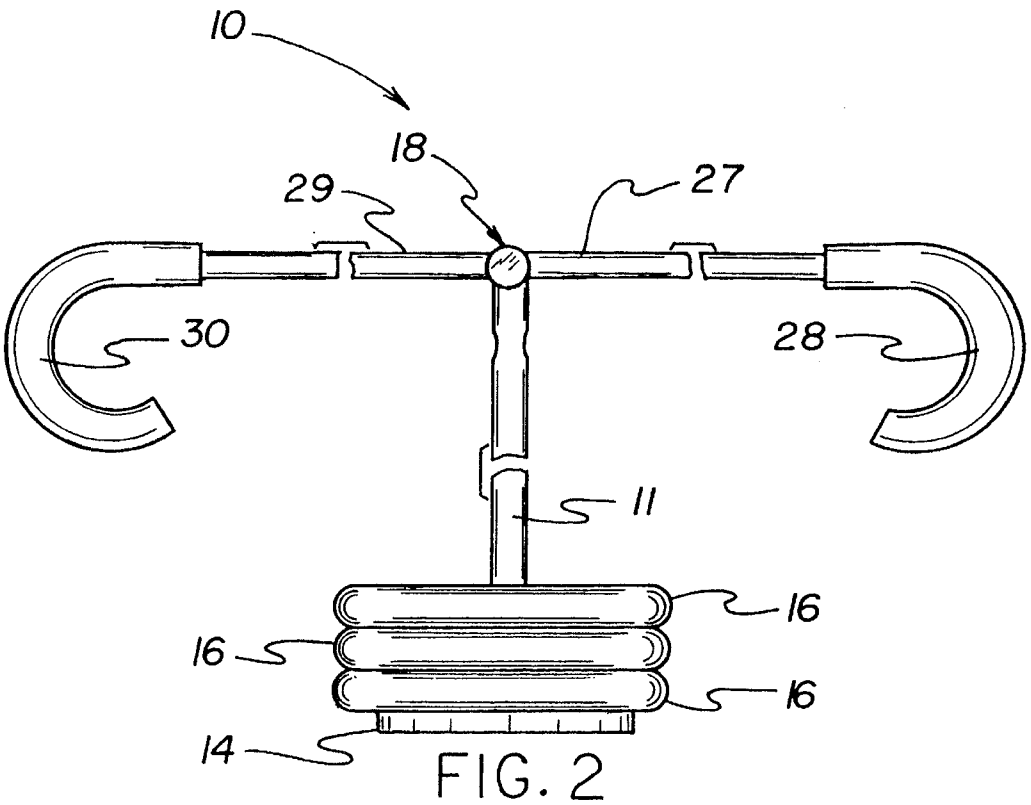
FIG. 2 is a side view, taken in elevation, of the invention in a second position.

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

The arm exercise device 10 of the invention comprises a central rod 11 having a rod first end 12 spaced from a rod second end 13. A support plate 14 is provided having a plate threaded boss 15 fixedly mounted substantially medially of the support plate 14, with the threaded boss arranged to threadedly receive the central rod second end 13, such as indicated in the FIG. 5. Alternatively, the central rod may be received through the support plate utilizing a conventional fastener to secure the rod below the plate 14, but to provide for a substantially planar bottom surface of the support plate 14 for ease of resting the organization upon an underlying support surface, the present configuration is employed.

Figure 4:
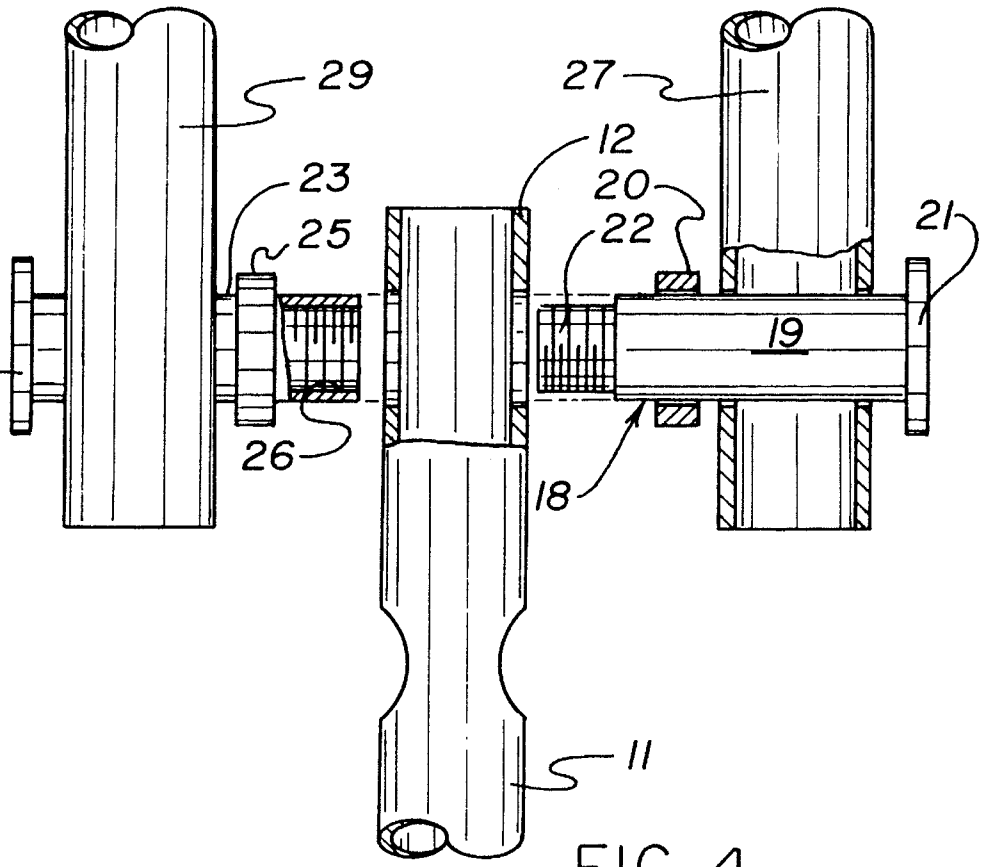
FIG. 4 is an enlarged orthographic view indicated partially in section and in exploded view to indicate the various components set forth by section 4 in FIG. 3.
Figure 3:
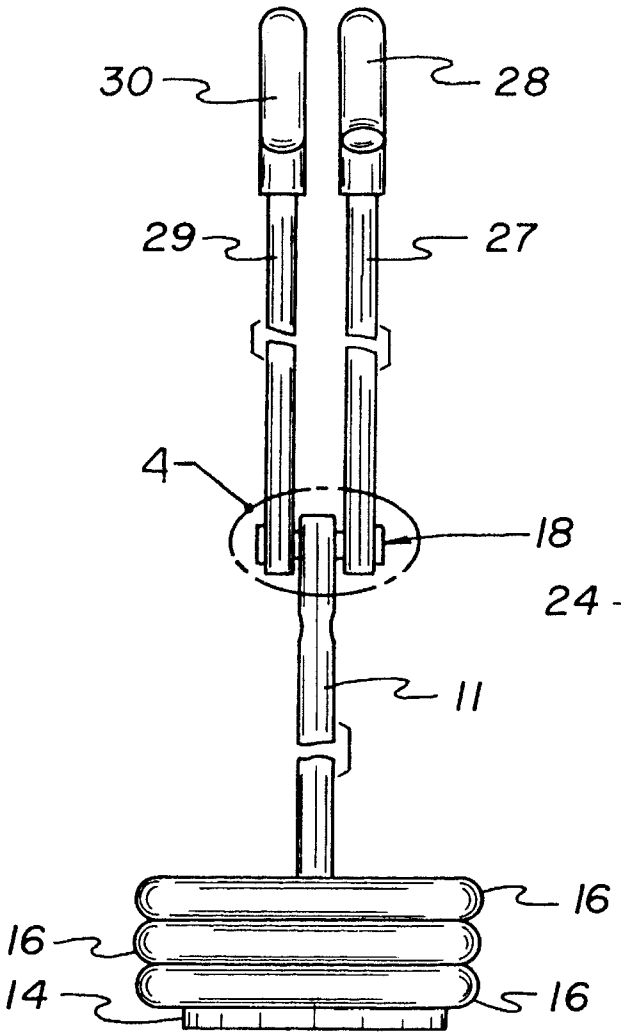
FIG. 3 is a side view, taken in elevation, of the invention rotated ninety degrees relative to the FIGS. 1 and 2.

The central rod first end 12 is provided with a pivot axle 18, indicated in greater detail in FIG. 4. The pivot axle 18 is provided with a first axle shaft 19, having a first bushing 20 rotatably mounted about the axle shaft 19 to provide for ease of pivoting of a first handle rod 27 that is rotatably mounted about the first axle shaft 19. A first abutment plate 21 captures the first handle rod 27 between the first abutment plate 21 and the first bushing 20 that is oriented between the first handle rod 27 and the central rod 11, with the first axle shaft 19 having an axle threaded boss 22 that extends through the central rod 11 and is threadedly received within a second axle threaded socket 26 of a second axle 23. A second bushing 25 is oriented between a second handle rod 29 and the central rod 11, with the second handle rod 29 captured between the second bushing 25 and a second abutment plate 24, as illustrated in FIG. 4, permitting the second handle rod 29 to be pivotally mounted about the second axle shaft 23.

Figure 1:
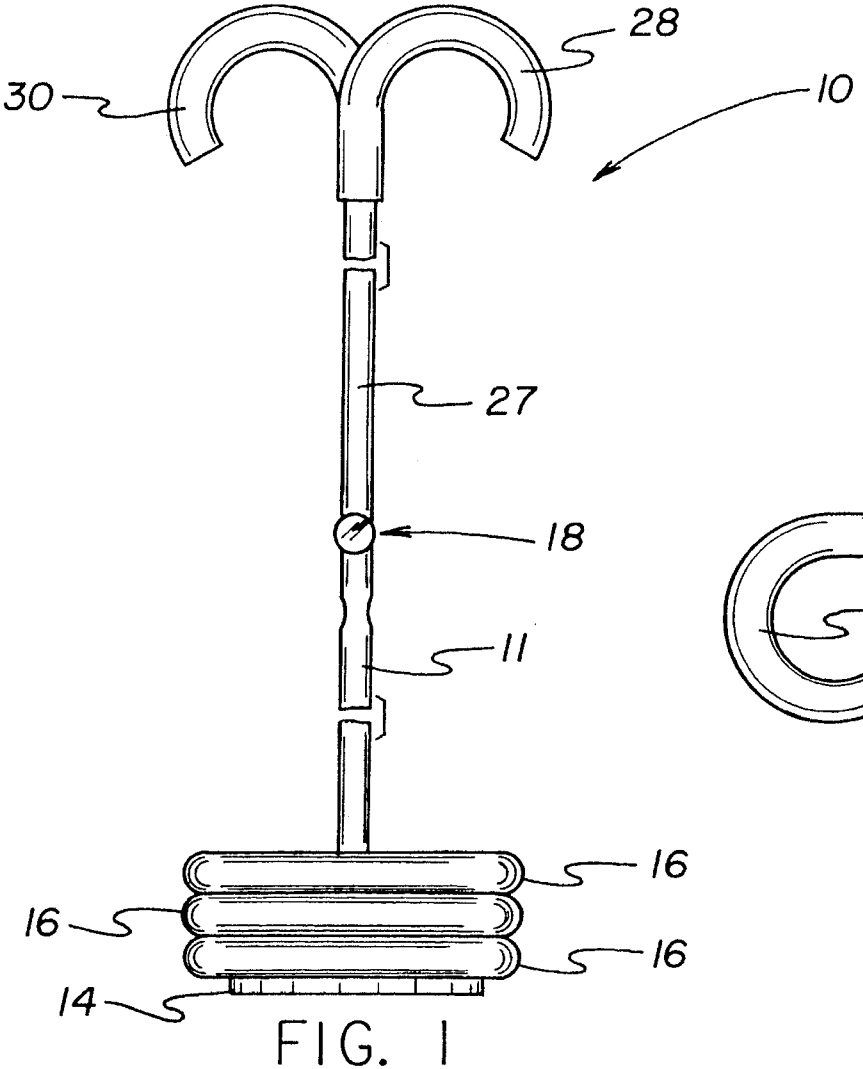
FIG. 1 is a side view, taken in elevation, of the invention in a first position.

The first handle rod 27 terminates in a first handle 28, with the second handle rod 29 terminating in a second handle 30. To this end, an individual grasps the first and second handles 28 and 30 respectively, as illustrated in FIG. 1, and by laterally extending an individual's arms, the central rod 11 and the associated resistance plates 16 are raised as the individual's arms are laterally extended to orient the first and second handle rods in the second position, as illustrated in FIG. 2.

Figure 7:
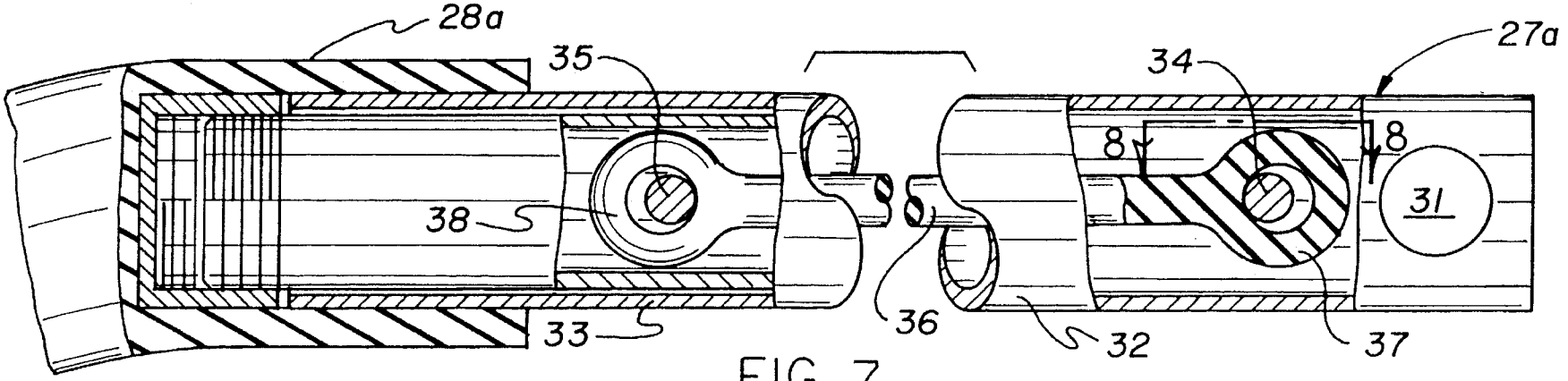
FIG. 7 is a side view, partially in cross-section, of a modified handle rod.
Figure 9:
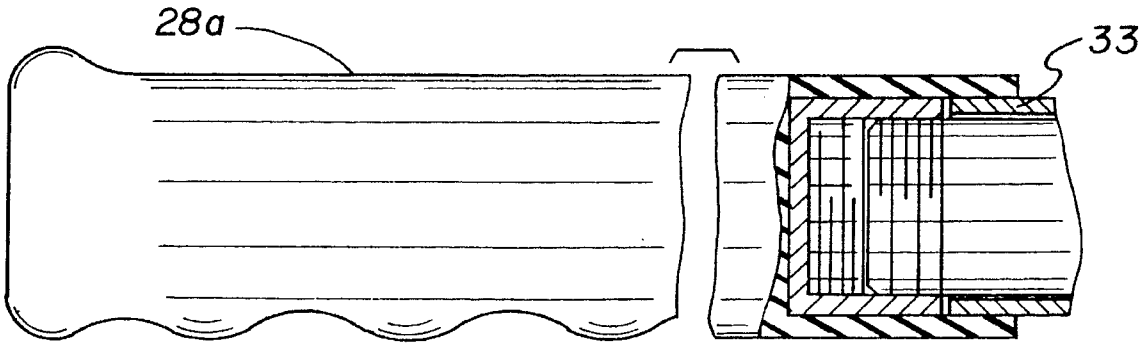
FIG. 9 is a side view, taken partially in cross-section, indicating the securement of a modified handle relative to the rod structure, as indicated in FIG. 7.
Figure 8:
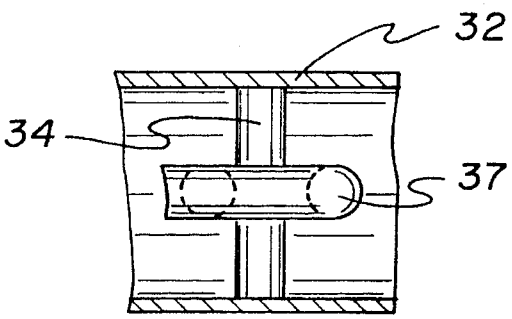
FIG. 8 is a view, taken along the lines 8—8 of FIG. 7 as indicated.

The FIGS. 7–9 indicate the use of a modified handle rod 27*a* that may be employed by each of the handle rods 27 and 29. To this end, the modified handle rod includes an axle bore 31 to receive the pivot axle 18 therethrough relative to the central rod 11. A first handle tube 32 is received within a second handle tube 33 in a slidable relationship, such that a first pin 34 fixedly mounted within the first handle tube 32 is spaced from a second pin 35 mounted within the second handle tube 33, each having a predetermined pin diameter. A connecting link 36 directed between the first and second pins 34 and 35 has a first head 37 at one end thereof, and a second head 38 at an opposed end thereof. The first and second heads 37 and 38 have a head diameter substantially greater than the pin diameter permitting a sliding and rotative relationship to a limited extent of the respective first and second handle tubes 32 and 33. A modified handle member 28*a* as indicated is secured threadedly to the second handle tube 33.

Figure 5:
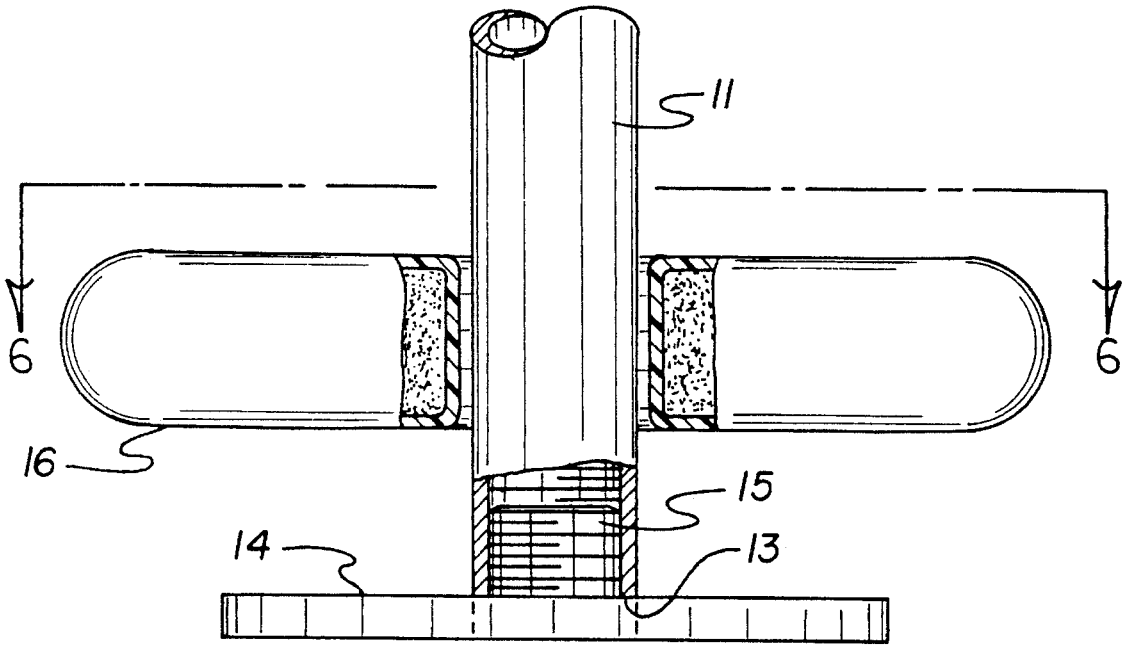
FIG. 5 is an enlarged view, partially in section, taken in elevation of the support base mounting a resistance plate relative to the central rod.
Figure 6:
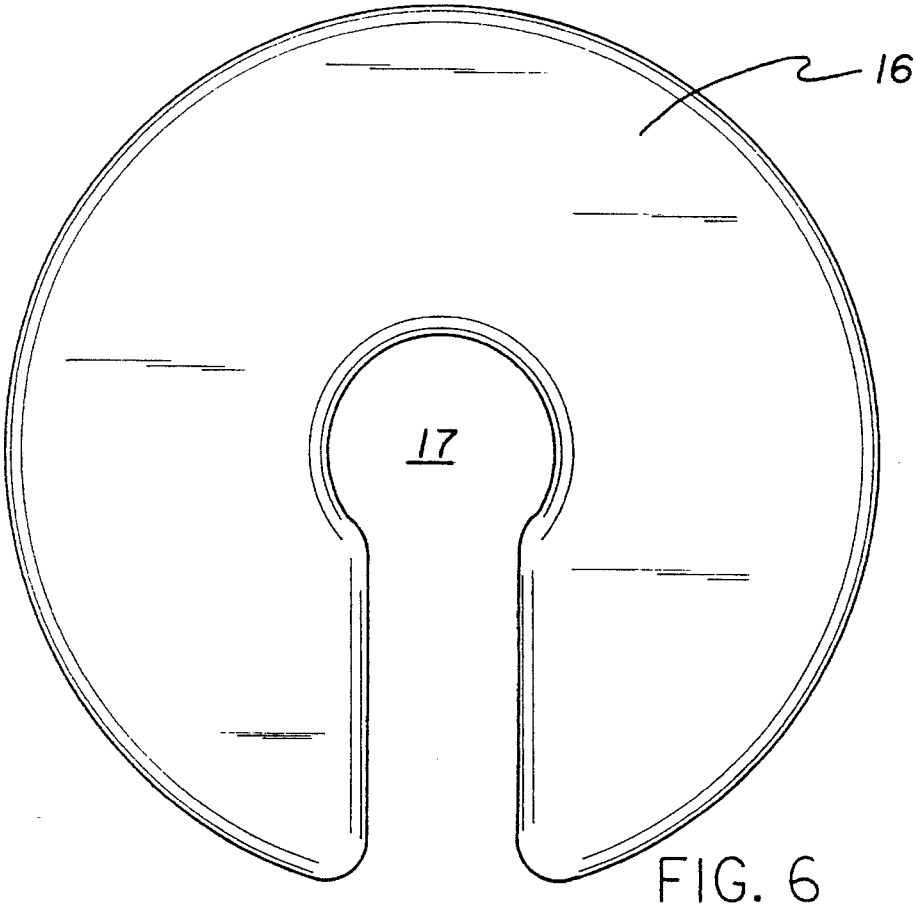
FIG. 6 is a plan view of a resistance plate, as indicated in FIG. 5.

It should be noted that each of the resistance plates 16 may be filled with a granular material, such as illustrated in FIG. 5, or alternatively may be of solid type construction. Further, it should be noted that each of the resistance plates 16 is provided with a keyhole opening 17, such as illustrated, or alternatively a mere central bore may be provided in lieu of the keyhole opening as the keyhole opening extends through a periphery of the resistance plate 16.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A hand-held type arm exercise device, comprising, a central rod, the central rod having a rod first end spaced from a rod second end, and a support plate, the support plate having securement means cooperatively mounted to the support plate for selective securement of the central rod second end to the support plate, and at least one resistance plate arranged for reception onto the support plate about the central rod, a pivot axle directed orthogonally through the central rod adjacent the central rod first end, with a first handle rod pivotally mounted to the pivot axle on a first side of the central rod, and a second handle rod pivotally mounted to the pivot axle adjacent the second side of the central rod, with the first handle rod having a first arcuate handle, and the second handle rod having a second arcuate handle for ease of manual grasping of the first handle and the second handle.

2. A device as set forth in claim 1 wherein the pivot axle includes a first axle shaft rotatably directed through the first handle rod, and the first axle shaft having a first abutment plate and a first bushing, with the first handle rod captured between the first bushing and the first abutment plate, with the first axle shaft having an axle threaded boss extending through the central rod, with the pivot axle further having a second axle shaft, with the second axle shaft having a threaded socket threadedly receiving the threaded boss, and a second bushing rotatably mounted about the second axle shaft, and the second axle shaft having a second abutment plate, with the second handle rod captured between the second bushing and the second abutment plate.

3. A device as set forth in claim 2 wherein at least the first handle rod includes a first handle tube slidably received within a second handle tube, and a first pin fixedly mounted within the first handle tube, and a second pin fixedly mounted to the second handle tube, and a connecting link extending between the first pin and the second pin, with the first pin and second pin having a pin diameter, and the connecting link having a first head receiving the first pin therethrough, and a second head secured to the connecting link receiving the second pin therethrough, with the first head and second head each having a head diameter greater than the pin diameter to permit limited rotation and sliding cooperation of the first handle tube to the second handle tube.

* * * * *